United States Patent [19]

Patterson

[11] 4,354,452

[45] Oct. 19, 1982

[54] EXPANDABLE EDGE DAM ASSEMBLY FOR PAPER COATING APPARATUS

[75] Inventor: Harvey J. Patterson, Wisconsin Rapids, Wis.

[73] Assignee: Consolidated Papers, Inc., Wisconsin Rapids, Wis.

[21] Appl. No.: 256,102

[22] Filed: Apr. 21, 1981

[51] Int. Cl.[3] ..... B05C 3/18

[52] U.S. Cl. ..... 118/413; 277/34

[58] Field of Search ..... 118/413, 407, 410; 49/477; 277/34

[56] References Cited

U.S. PATENT DOCUMENTS 2,818,120 12/1957 Whitton ..... 277/34

4,327,662 5/1982 Damrau ..... 118/413 X

*Primary Examiner*—Evan K. Lawrence

*Attorney, Agent, or Firm*—Gary, Juettner & Pyle

[57] ABSTRACT

An edge dam or edge seal assembly for an applicator for applying a coating liquid to a moving web of paper carried on a backing roll, the applicator being of the type having a chamber for receiving coating liquid and an opening therein for directing the liquid onto the web, the opening being formed between a front wall of the chamber and a doctor blade exending from the rear of the opening to against the web, is characterized by an expandable seal element sealed with the front wall and doctor blade in an end space therebetween and extending toward and closely adjacent to but spaced from the web. The seal element is of a flexible material and accommodates the introduction of pneumatic or hydraulic fluid under pressure therein for expanding the same to a size which fills the end space and seals the same, and which extends a sealing surface of the element very closely adjacent to the web or backing roll. Consequently, leakage of coating past the seal element may be accurately controlled and significantly minimized.

14 Claims, 4 Drawing Figures

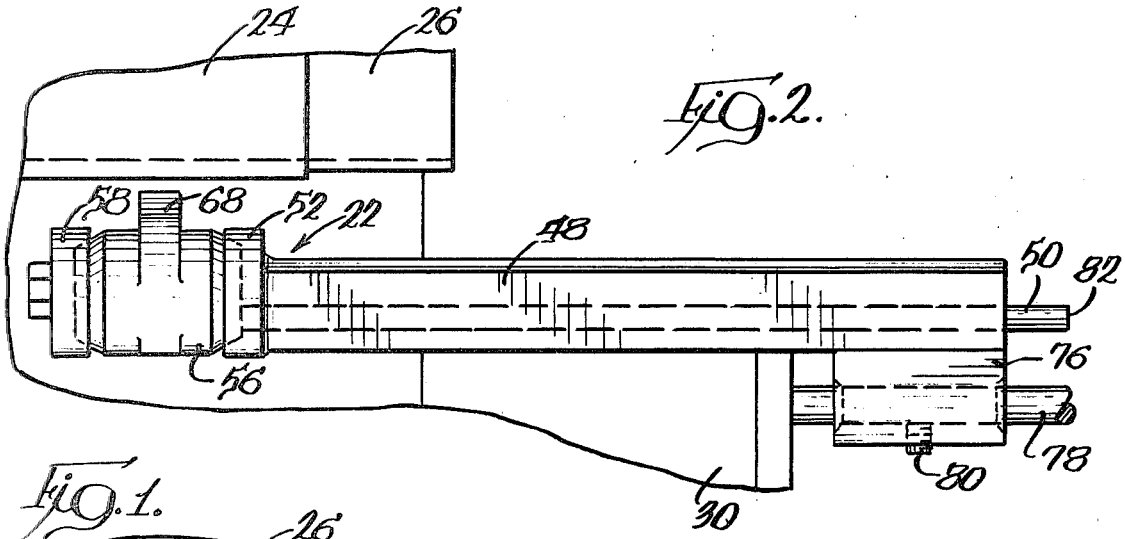
Fig. 2.
Fig. 1.
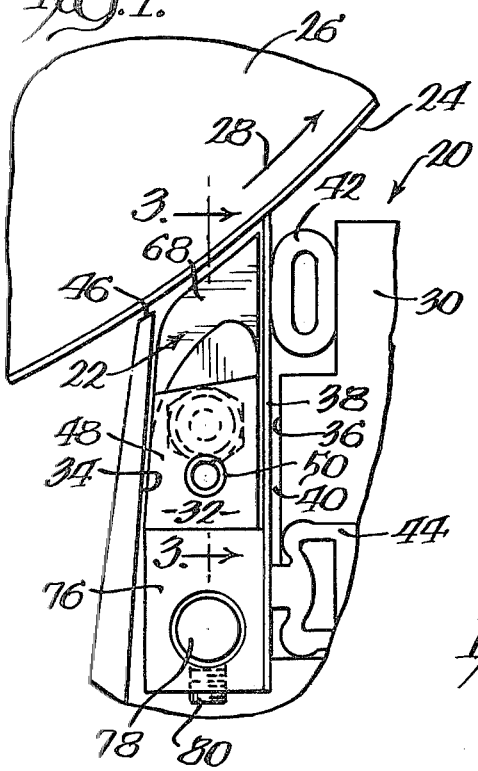
Fig. 3.
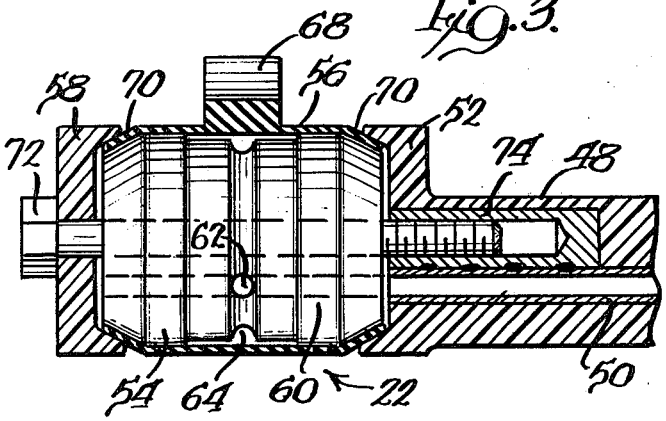
Fig. 4.
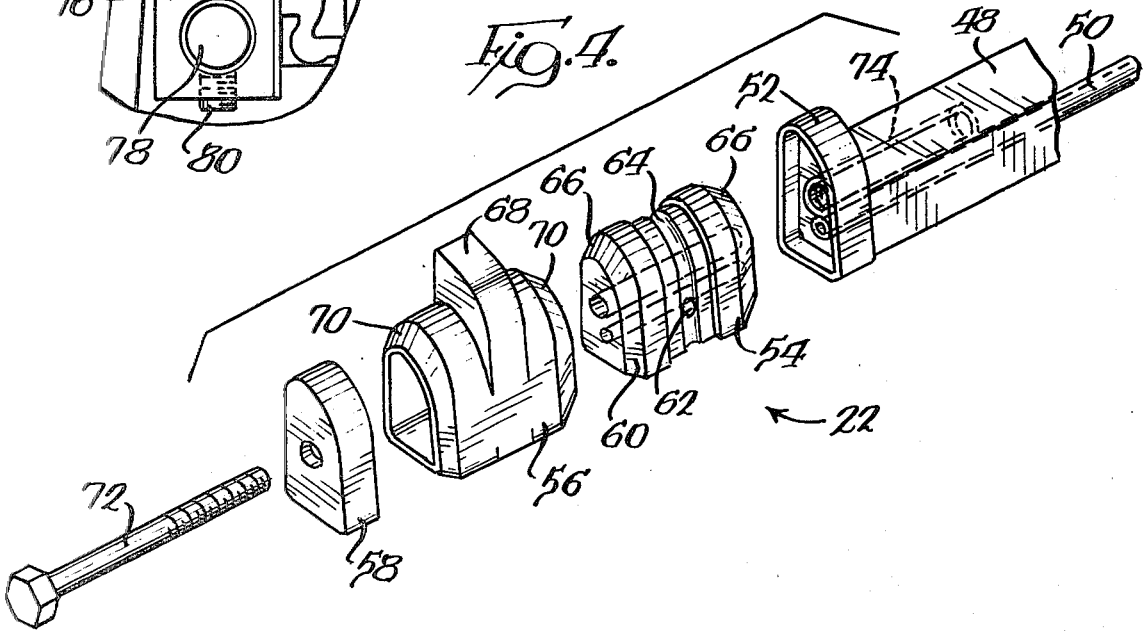

EXPANDABLE EDGE DAM ASSEMBLY FOR PAPER COATING APPARATUS

BACKGROUND OF THE INVENTION

The present invention relates to an improved edge dam or edge seal for use with applicators of the trailing blade type for applying a coating liquid to a moving web of paper.

Conventional applicators of the trailing blade type include means for applying coating material to a paper web that is usually supported and carried by a backing roll. Such applicators include a chamber having an opening extending across and parallel to the web, together with a doctor blade located at a trailing side of the opening for leveling the coating and a front wall or orifice plate extending from a leading side of the opening toward the web and defining an orifice for exit of excess coating material from an application zone between the wall and doctor blade. Coating liquid is supplied to the chamber and thence through the chamber opening to the application zone, and to seal the end spaces between the front wall and doctor blade to prevent escape of coating material laterally of the web, edge dams or edge seals are provided thereat.

For applicators of the foregoing type, the edge seal often comprises a solid bar of plastic, usually nylon, machined to fill a somewhat triangular shaped opening at either end of the coating zone defined by the doctor blade, orifice plate and backing roll. Ideally, the edge seal absolutely prevents leakage of any coating liquid to exterior of the applicator. However, that can require that the edge seal be in contact with the backing roll or web, and wear or abrasion of the seal and backing roll or marking and tearing of the web may occur. Consequently, the edge seal is only positioned closely adjacent to, but spaced from, the backing roll, and coating liquid seeps therepast.

In use of edge seals, an effort is made to minimize leakage of coating liquid. However, because conventional edge seals are relatively rigid, it is usually very difficult if not impossible to mount the same at the side ends of the application zone in sufficiently close proximity with the backing roll to allow only an acceptably small amount of leakage. Thus, in practice excessive coating liquid often leaks past the edge seals and the backing roll and/or paper web edges become contaminated with coating material.

If leakage of coating liquid past edge seals could be eliminated or at least significantly minimized, it would then be possible to coat only the center portion of the paper web, leaving narrow uncoated strips along the side edges of the web. This would advantageously reduce or eliminate coating material buildup on backing rolls following the coater as well as edge stickers on the coater backing roll. Unfortunately, conventional edges seals do not ordinarily permit the foregoing to be accomplished.

OBJECTS OF THE INVENTION

An object of the present invention is to provide an improved edge seal for a paper coater which eliminates or very significantly minimizes leakage of coating material therepast.

A further object of the invention is to provide such an edge seal which is of a flexible material expandable under pressure of hydraulic or pneumatic fluid to substantially completely fill the opening at side ends of the application zone.

SUMMARY OF THE INVENTION

In accordance with the present invention, an improved edge seal assembly is provided for use with an applicator for applying a coating liquid to a moving web of paper, wherein the applicator is of a type having a body defining a chamber therein with an elongate opening to the chamber positionable generally adjacent to and transversely of the web and the chamber receives coating liquid and directs the same through the opening and onto the web. Said edge seal assembly comprises seal means of a flexible and expandable material mountable in the opening toward a longitudinal end thereof, and means for introducing fluid under pressure into said seal means to expand the same for sealing with the body on opposite sides of the chamber opening and for extending toward and closely adjacent to but spaced from the paper web, whereby said seal means seals the side end of said opening and controls leakage of coating liquid therepast.

The invention also provides an improved applicator and edge seal assembly for applying a coating liquid to a moving web of paper carried on a backing roll, which comprises a body defining a chamber therein with an elongate opening to said chamber positionable adjacent to and transversely of the web, said chamber receiving coating liquid therein and directing the same through said opening onto the web; a front wall extending from a front side of said chamber opening toward, adjacent to and transversely of the web; a doctor blade extending from a rear side of said chamber opening transversely of and against the web for doctoring the coating liquid on the web; and edge seal means at each opposite side end of said front wall and doctor blade for sealing the end spaces therebetween. Each edge seal means comprises seal means of a flexible and expandable material mounted between said front wall and said doctor blade and extending toward but spaced from the paper web or said backing roll, and means for introducing fluid under pressure into said seal means to expand the same into sealed engagement with said front wall and doctor blade and to extend the same closely adjacent to but spaced from the paper web or said backing roll, whereby said seal means seals the side end of said applicator and controls leakage of coating liquid therepast.

By virtue of the edge seal means being expandable under control of fluid pressure, the same may readily and conveniently be adjusted or expanded to a size very closely conforming in shape with the opening to be sealed, whereby only minimum acceptable amounts, if any, of coating liquid leak therepast. Consequently, in use of the edge seal means of the invention contamination of the backing roll with coating liquid and the formation of stickers on the side edges of the paper web are eliminated or at least significantly minimized.

The foregoing and other objects, advantages and features of the invention will become apparent upon a consideration of the following detailed description, when taken in conjunction with the accompanying drawings.

BRIEF DESCRIPTION OF THE DRAWINGS

FIG. 1 is a side elevation view of an edge seal assembly constructed in accordance with the teachings of the present invention, illustrating the same on an applicator for applying a coating liquid to a moving web of paper carried on a backing roll;

FIG. 2 is a longitudinal view of the edge seal assembly of FIG. 1, showing one possible orientation of the same with respect to the web of paper and backing roll;

FIG. 3 is a cross sectional side elevation view of the edge seal assembly, taken substantially along the lines 3—3 of FIG. 1, and FIG. 4 is a perspective assembly view of the edge seal assembly.

DETAILED DESCRIPTION

Referring to FIG. 1, there is indicated generally at 20 an applicator of a type with which an edge dam or edge seal assembly, indicated generally at 22 and configured in accordance with the teachings of the invention, is particularly adapted for use. The applicator applies a pigment bearing liquid coating to a moving web of paper 24 carried on a resilient backing roll 26 in a direction indicated by an arrow 28, and includes a main support or housing 30 having a coating liquid chamber 32 defined between a front or leading wall 34 and a rear or trailing wall 36 of the support. The walls extend generally transversely of the backing roll and taper toward an open upper end or application zone of the chamber. Coating liquid is introducd into the chamber for flowing into the application zone and against the web of paper, and although not shown the lower sides of the chamber are closed by side walls extending between the front and rear walls.

During operation, the coating applicator 20 is positioned closely adjacent the backing roll with the opening or elongate application zone in the upper end of the chamber 32 facing the surface of the paper web 24. A flexible doctor blade 38 is in a slot 40 in the main support 30 to form a portion of the chamber rear wall, and is clamped in place and urged against the web by a pair of transversely extending air tubes 42 and 44. The doctor blade serves several functions, one of which is to level the coating applied to the web and another of which is to form a seal at the trailing end of the applicator to prevent escape therepast of excessive amounts of coating liquid. The pressure of the blade on the roll is conveniently regulated by the pressure of the air within the tube 42, the tube for this purpose extending transversely of the web along the length of the doctor blade for applying an even pressure against the blade across the entire width of the web. The upper end of the front wall 34 is adjustable toward and away from the paper web to define a narrow orifice 46 at the leading end of the application zone between the front wall and the web, through which excess coating material may escape from the application zone. The escaping coating material forms a liquid seal in the orifice 46 and provides, along with the edge seals 22, the front wall 34 and the doctor blade, a substantially closed application zone through which the paper web passes for being coated.

To accomplish sealing of the spaces at the side ends of the application zone and between the front wall 34 and doctor blade 38 of the applicator main support 30, an edge seal assembly 22 is positioned at each side end. As shown in FIGS. 2, 3 and 4, which illustrate an edge seal assembly configured in accordance with the present invention, the assembly is mounted on a main body element 48 which may be of metal or a rigid or semi-rigid plastic material, such as a hard polyurethane. A stainless steel hollow tube 50 is molded into the body element for rigidity or stiffening thereof, as well as for conveying pneumatic or hydraulic fluid under pressure to the edge seal assembly, and extends from exterior of the body element at one end thereof to and in communication with the interior of a generally triangular shaped end cap 52 formed integrally with the body element at an opposite end thereof.

The end cap 52 comprises a portion of the edge seal assembly 22, the remainder of which includes a spool piece 54 of a relatively rigid material such as nylon, an expandable bladder or boot 56 made of a flexible material such as polyurethane and a second generally triangular shaped end piece 58 of a relatively rigid material such as nylon or hard polyurethane. The spool has a passage 60 formed longitudinally therethrough which, when the edge seal is assembled, communicates with the passage through the tube 50; a passage 62 communicating between the passage 60 and a recess 64 in the periphery of the spool and tapered end surfaces 66. The bladder includes a generally triangular shaped seal portion 68 which extends outwardly thereof and tapered surfaces 70 at its opposite ends.

To assemble the edge seal, and with reference also to FIG. 3, the bladder 56 is slid or positioned around the spool 54, such that the inside surfaces of the tapered ends 70 of the bladder are located against the tapered surfaces 66 of the spool. The bladder and spool are then placed between the end caps 52 and 58, such that the tapered surfaces 70 of the bladder extend within and engage the outer ends of the caps. A bolt 72 is then extended through aligned passages in the end cap 58 and the spool into engagement with a threaded dowel 74 attached to the tube 50 and molded within the body element 48. Tightening the bolt 72 draws the end caps together into sealed engagement with the bladder so that, with the head of the bolt closing the passage through the end cap 58, a chamber is defined between the bladder and spool with the passage 62 in communication with the chamber and the passage 60 aligned with the passage through the tube.

The generally triangular shape of the end seal assembly 22 enables the assembly to be mounted in the space between the doctor blade 38, the front wall 34 and the backing roll 26 at a side end of the application zone. For the purpose, and as shown in FIG. 2, the main body element 48 has a downwardly depending flange 76 which receives a rod 78 extending outwardly of the main support 30 transversely of the coating liquid chamber 32. The flange is secured to the rod by means of a set screw 80, which enables the edge seal assembly to be conveniently removed from the applicator by being slid transversely therefrom for cleaning, repair or replacement. With the edge seal assembly mounted between the doctor blade and front wall, the upper end of the triangular shaped seal portion 68 of the bladder 56 extends toward and closely adjacent to but spaced from the backing roll 26. At the same time, the sides of the seal portion 68 are positioned against or very closely adjacent to the doctor blade and front wall.

FIGS. 1 and 2 illustrate the mounting arrangement of the edge seal assembly 22 on the applicator main support 30. As is seen, the seal portion 68 of the bladder 56 lies in a plane extending generally perpendicular to the axis of rotation of the backing roll 26 or parallel to the direction of movement of the paper web 24. As is apparent, the configuration and size of the edge seal assembly is quite important, and the assembly must substantially fill the area between the doctor blade 38, the front wall 34 and the backing roll when the blade is in its doctoring position. If the edge seal assembly is too small, coating material will seep therepast. If the assembly is too large, the doctor blade will be held from its doctoring position against the paper web and/or the seal portion 68 will engage the backing roll or paper web.

To obtain a secure seal between the doctor blade 38 and the leading wall 34 of the applicator main support 30, as well as between the backing roll and the upper end of the seal portion 68 of the bladder 56, an outer end 82 of the tube 50 is connected with a source (not shown) of hydraulic or pneumatic fluid under pressure. The fluid is then introduced through the tube and the passages 60 and 62 in the spool 54 to the interior of the bladder 56 to expand the same to a size whereat it essentially fills the triangular shaped opening between the doctor blade and front wall, with the upper end of the seal portion 68 very closely approaching, but being spaced from, the paper web or backing roll. The pressure of the pneumatic or hydraulic fluid is adjusted to cause the flexible bladder to expand to a point whereat it contacts and seals with the front wall and doctor blade and closely approaches the backing roll, and is then maintained at that pressure during coating. On the other hand, should any or excessive seepage past the edge seal be observed during coating, the particular arrangement enables the size of the edge seal to conveniently be adjusted to control the seepage during and without interruption of the coating operation. To facilitate insertion and removal of the seal assembly into and from the coater, the bladder 56 is preferably of a size, when deflated, to substantially but not completely fill the area between and at the side end of the front wall, doctor blade and backing roll, with final adjustment of the size of the edge seal then being controlled and determined by the pressure of fluid introduced therein.

As compared with conventional edge seals which are substantially fixed in size and shape, the expandable edge seal of the invention is readily adjustable to provide a secure seal at the side ends of the application zone to precisely control and significantly minimize, if not eliminate, seepage of coating material therefrom. The pressure of the fluid within the expandable bladder 56 may precisely and conveniently be controlled to position the edge seal very closely adjacent to, yet spaced from, the paper web or backing roll, so that substantially no coating liquid seeps therepast, which seepage control is very difficult if not impossible to obtain with conventional edge seals. Consequently, and since virtually no coating material escapes past the edge seal assembly, use of the same, when positioned as shown in FIG. 2, permits a dry or uncoated narrow strip to remain on each side edge of the paper web, which advantageously reduces coating material buildup on rolls following the applicator and eliminates edge stickers on the backing roll of the applicator.

While one embodiment of the invention has been described in detail, various modifications and other embodiments thereof may be devised by one skilled in the art without departing from the spirit and scope of the invention, as defined in the appended claims.

What is claimed is:

1. In combination with an applicator for applying a coating liquid to a moving web of paper, said applicator having a body defining a chamber therein with an elongate opening to said chamber positionable generally adjacent to and transversely of the web, said chamber receiving coating liquid and directing the same through said opening and onto the web, an improved edge seal assembly comprising seal means of a flexible and expandable material mounted in said opening toward a longitudinal end thereof; and means for introducing fluid under pressure into said seal means to expand the same for sealing with said body on opposite sides of said chamber opening and for extending toward and closely adjacent to but spaced from the paper web, whereby said seal means seals the side end of said opening and controls leakage of coating liquid therepast.

2. The combination as in claim 1, wherein said seal means comprises a flexible and expandable bladder, and including a relatively rigid member within said bladder for supporting the same, said member and bladder, when said bladder is deflated, being of a size permitting insertion of the same in said chamber opening toward the longitudinal end thereof, said means for introducing fluid under pressure introducing the same into an area between an inner surface of said bladder and an outer surface of said member to expand said bladder outwardly of said member to seal said side end of said chamber opening.

3. The combination as in claim 1, wherein said seal means comprises a flexible and expandable bladder, and including a spool of relatively rigid material within said bladder for supporting the same, said spool having a plurality of passages therein communicating with the area between an outer surface of said spool and an inner surface of said bladder, said means for introducing fluid under pressure introducing the same through said passages to expand said bladder outwardly of said spool to seal said side end of said chamber opening.

4. An improved edge seal assembly for use with an applicator for applying a coating liquid to a moving web of paper, wherein the applicator is of a type having a body defining a chamber therein with an elongate opening to the chamber positionable generally adjacent to and transversely of the web, the chamber receiving coating liquid and directing the same through the opening and onto the web, said edge seal assembly comprising seal means of a flexible and expandable material mountable in the opening toward a longitudinal end thereof; and means for introducing fluid under pressure into said seal means to expand the same for sealing with the body on opposite sides of the chamber opening and for extending toward and closely adjacent to but spaced from the paper web, whereby said seal means seals the side end of said opening and controls leakage of coating liquid therepast, wherein said seal means comprises a flexible and expandable bladder, and including a spool of relatively rigid material within said bladder for supporting the same, said spool having a plurality of passages therein communicating with the area between an outer surface of said spool and an inner surface of said bladder, said means for introducing fluid under pressure introducing the same through said passages to expand said bladder outwardly of said spool to seal the side end of the chamber opening, and wherein said bladder has a generally triangular shaped portion extending outwardly therefrom and extendable toward the paper web, said spool has a groove in its outer surface aligned with said triangular shaped portion and at least one of said spool passages terminates in said groove, whereby upon introduction of fluid under pressure through said passages said triangular shaped portion expands to seal with the body on opposite sides of the chamber opening and to extend closely toward and adjacent to but spaced from the paper web by an amount determined by the pressure of the fluid.

5. An improved edge seal assembly for use with an applicator for applying a coating liquid to a moving web of paper, wherein the applicator is of a type having a body defining a chamber therein with an elongate opening to the chamber positionable generally adjacent to and transversely of the web, the chamber receiving coating liquid and directing the same through the opening and onto the web, said edge seal assembly comprising seal means of a flexible and expandable material mountable in the opening toward a longitudinal end thereof; and means for introducing fluid under pressure into said seal means to expand the same for sealing with the body on opposite sides of the chamber opening and for extending toward and closely adjacent to but spaced from the paper web, whereby said seal means seals the side end of said opening and controls leakage of coating liquid therepast, wherein said seal means comprises a flexible and expandable bladder, and including a spool of relatively rigid material within said bladder for supporting the same, said spool having a plurality of passages therein communicating with the area between an outer surface of said spool and an inner surface of said bladder, said means for introducing fluid under pressure introducing the same through said passages to expand said bladder outwardly of said spool to seal the side end of the chamber opening, and wherein said bladder and spool are mounted at an end of an elongate, relatively rigid element, said element has a passage extending therethrough and in communication with said spool passages and said means for introducing fluid under pressure introduces the fluid through said element passage.

6. An improved edge seal assembly as in claim 5, wherein said bladder and spool are mounted on said element in longitudinal alignment therewith and said bladder has openings thereto at its longitudinal ends accommodating insertion of said spool therein, and including a pair of end caps over said openings and sealed with said bladder, said end cap toward said elongate mounting element accommodating communication of said element passage with said spool passages.

7. An improved edge seal as in claim 6, wherein said end cap toward said elongate element is formed integrally with said element and said element passage extends therethrough, and including means for urging said end caps toward each other and against said bladder to maintain said seals therebetween.

8. An improved applicator and edge seal assembly for applying a coating liquid to a moving web of paper carried on a backing roll, comprising a body defining a chamber therein with an elongate opening to said chamber positionable adjacent to and transversely of the web, said chamber receiving coating liquid therein and directing the same through said opening onto the web; a front wall extending from a front side of said chamber opening toward, adjacent to and transversely of the web; a doctor blade extending from a rear side of said chamber opening transversely of and against the web for doctoring the coating liquid on the web; and edge seal means at each opposite side end of said front wall and doctor blade for sealing the end spaces therebetween, each edge seal means comprising seal means of a flexible and expandable material mounted between said front wall and said doctor blade and extending toward but spaced from the paper web or said backing roll, and means for introducing fluid under pressure into said seal means to expand the same into sealed engagement with said front wall and doctor blade and to extend the same closely adjacent to but spaced from the paper web or said backing roll, whereby said seal means seals the side end of said applicator and controls leakage of coating liquid therepast.

9. An improved applicator and edge seal assembly as in claim 8, wherein said seal means comprises a flexible and expandable bladder, and including a relatively rigid member within said bladder for supporting the same, said member and bladder, when said bladder is deflated, being of a size permitting insertion of the same between said front wall and doctor blade, said means for introducing fluid under pressure introducing the same into an area between an inner surface of said bladder and an outer surface of said member to expand said bladder outwardly of said member to seal the side end of said applicator.

10. An improved applicator and edge seal assembly as in claim 8, wherein said seal means comprises a flexible and expandable bladder, and including a spool of relatively rigid material within said bladder for supporting the same, said spool having a plurality of passages therein communicating with the area between an outer surface of said spool and an inner surface of said bladder, said means for introducing fluid under pressure introducing the same through said passages to expand said bladder outwardly of said spool to seal the side end of said applicator.

11. An improved applicator and edge seal assembly as in claim 10, wherein said bladder has a generally triangular shaped portion extending outwardly therefrom toward the paper web, said spool has a groove in its outer surface aligned with said triangular shaped portion and at least one of said spool passages terminates in said groove, whereby upon introduction of fluid under pressure through said passages said triangular shaped portion expands to seal with said front wall and doctor blade on opposite sides of said chamber opening and to extend closely toward and adjacent to but spaced from the paper web or said backing roll by an amount determined by the pressure of the fluid.

12. An improved applicator and edge seal assembly as in claim 10, wherein said bladder and spool are mounted at an end of an elongate, relatively rigid element, said element has a passage extending therethrough and in communication with said spool passages and said means for introducing fluid under pressure introduces the fluid through said element passage.

13. An improved applicator and edge seal assembly as in claim 12, wherein said bladder and spool are mounted on said element in longitudinal alignment therewith and said bladder has openings thereto at its longitudinal ends accommodating insertion of said spool therein, and including a pair of end caps over said openings and sealed with said bladder, said end cap toward said elongate mounting element accommodating communication of said element passage with said spool passages.

14. An improved applicator and edge seal as in claim 13, wherein said end cap toward said elongate element is formed integrally with said element and said element passage extends therethrough, and including means for urging said end caps toward each other and against said bladder to maintain said seals therebetween.

* * * * *